US009598783B2

(12) United States Patent
Duval et al.

(10) Patent No.: US 9,598,783 B2
(45) Date of Patent: Mar. 21, 2017

(54) ALUMINUM SMELTER COMPRISING ELECTRICAL CONDUCTORS MADE FROM A SUPERCONDUCTING MATERIAL

(75) Inventors: Christian Duval, Coublevie (FR); Steeve Renaudier, St. Michel de Maurienne (FR); Benoit Bardet, Villargondran (FR); Olivier Martin, Hermillon (FR); Stéphane Wan Tang Kuan, Poncharra (FR)

(73) Assignee: Rio Tinto Alcan International Limited, Montreal (CA)

( * ) Notice: Subject to any disclaimer, the term of this patent is extended or adjusted under 35 U.S.C. 154(b) by 187 days.

(21) Appl. No.: 14/232,168

(22) PCT Filed: Jul. 10, 2012

(86) PCT No.: PCT/FR2012/000282

§ 371 (c)(1),
(2), (4) Date: Jan. 10, 2014

(87) PCT Pub. No.: WO2013/007893

PCT Pub. Date: Jan. 17, 2013

(65) Prior Publication Data

US 2014/0138241 A1 May 22, 2014

(30) Foreign Application Priority Data

Jul. 12, 2011 (FR) ..... 11 02198
Jul. 12, 2011 (FR) ..... 11 02199

(51) Int. Cl.
*C25B 9/00* (2006.01)
*C25B 9/06* (2006.01)
(Continued)

(52) U.S. Cl.
CPC ..... *C25C 3/08* (2013.01); *C25C 3/16* (2013.01); *C25C 3/20* (2013.01)

(58) Field of Classification Search
CPC .... C25B 9/00; C25B 9/06; C25B 9/18; C25C 7/02; C25C 1/02; C25C 1/22; C25C 3/08; C25C 1/00; C25C 3/16; C25C 3/20
(Continued)

(56) References Cited

U.S. PATENT DOCUMENTS 4,169,034 A 9/1979 Morel et al.
4,713,161 A 12/1987 Chaffy et al.
(Continued)

FOREIGN PATENT DOCUMENTS

CA 2585218 A1 10/2007
EP 0204647 A1 12/1986
(Continued)

OTHER PUBLICATIONS

International Search Report and Written Opinion mailed Jan. 16, 2013 (PCT/FR2012/000282); ISA/EP.
(Continued)

*Primary Examiner* — Zulmariam Mendez
(74) *Attorney, Agent, or Firm* — Banner & Witcoff, Ltd.

(57) ABSTRACT

An aluminum smelter comprising:
(i) a series of electrolytic cells, designed for the production of aluminum, forming one or more rows,
(ii) a supply station designed to supply the series of electrolytic cells with an electrolysis current,
the said electricity supply station comprising two poles,
(iii) a main electrical circuit through which the electrolysis current flows, having two extremities each connected to one of the poles of the supply station,
(iv) at least one secondary electrical circuit comprising an electrical conductor made of superconducting material through which a current flows, running along the row or rows of electrolytic cells,
characterized in that the electrical conductor made of superconducting material in the secondary electrical
(Continued)

Figure 1:
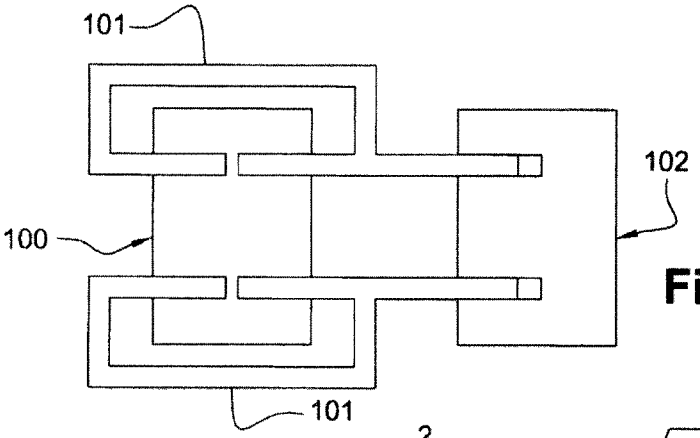

circuit runs along the row or rows of electrolytic cells at least twice in such a way as to make several turns in series.

14 Claims, 5 Drawing Sheets

(51) Int. Cl.

| | |
|---|---|
| ***C25B 9/18*** | (2006.01) |
| ***C25C 7/02*** | (2006.01) |
| ***C25C 1/02*** | (2006.01) |
| ***C25C 1/00*** | (2006.01) |
| ***C25C 3/08*** | (2006.01) |
| ***C25C 3/20*** | (2006.01) |
| ***C25C 3/16*** | (2006.01) |

(58) Field of Classification Search
USPC ..... 204/242, 244
See application file for complete search history.

(56) References Cited

U.S. PATENT DOCUMENTS

| | | | | |
|---|---|---|---|---|
| 5,683,559 | A | 11/1997 | De Nora | |
| 2007/0205099 | A1 | 9/2007 | Le Hervet et al. | |
| 2008/0041718 | A1 | 2/2008 | Pingin et al. | |
| 2009/0247412 | A1 | 10/2009 | Maguire et al. | |
| 2013/0300239 | A1* | 11/2013 | Rico | H02K 5/00 310/91 |

FOREIGN PATENT DOCUMENTS

| | | | |
|---|---|---|---|
| EP | 1812626 | A1 | 8/2007 |
| FR | 2425482 | A1 | 12/1979 |
| FR | 2469475 | A1 | 5/1981 |
| FR | 2868436 | A1 | 10/2005 |
| NZ | 195424 | A | 12/1984 |
| WO | 9853120 | A1 | 11/1998 |
| WO | 2006033578 | A1 | 3/2006 |
| WO | 2008011184 | A2 | 1/2008 |
| WO | 2008033034 | A1 | 3/2008 |

OTHER PUBLICATIONS

INPI Search Report mailed Mar. 14, 2012 (FR 1102198).
INPI Search Report mailed Mar. 9, 2012 (FR 1102199).
Runde: "Application of High-Tc Superconductors in Aluminum Electrolysis Plants", Jun. 1, 1995 (Jun. 1, 1995) XP055021684, Retrieved from the Internet: URL:http://ieeexplore.ieee.org/ielx4/77/9067/00402672.pdf?tp=&arnumber=402672&isnumber=9067 [retrieved on Mar. 13, 2012] the whole document.
Xuemin Liang et al: "Design of a 380 m DC HTS Power Cable", IEEE Transactions on Applied Superconductivity, IEEE Service Center, Los Alamitos, CA, US, vol. 20, No. 3, Jun. 1, 2010 (Jun, 1, 2010), pp. 1259-1262. XP011305396, ISSN: 1051-8223 the whole document.
Meyerhoff et al: "Superconducting power transmission", Cryogenics, Elsevier, Kidlington, GB, vol. 11, No. 2, Apr. 1, 1971 (Apr. 1, 1971), pp. 91-101, XP024048068, ISSN: 0011-2275, DOI: 10.1016/0011-2275(71)90288-8 [retrieved on Apr. 1, 1971] Recent studies ( . . . ) aluminum plant.; col. 2. lines 20-25.
Yinshun Wang et al: "A Novel Approach for Design of DC HTS Cable", IEEE Transactions on Applied Superconductivity, IEEE Service Center, Los Alamitos, CA, US, vol. 21, No. 3, Jun. 1, 2011 (Jun. 1, 2011), pp. 1042-1045, XP011324945, ISSN: 1051-8223, DOI: 10.1109/TASC.2010.2089595 I. Introduction.

* cited by examiner

ALUMINUM SMELTER COMPRISING ELECTRICAL CONDUCTORS MADE FROM A SUPERCONDUCTING MATERIAL

The present application is a U.S. National Phase filing of International Application No. PCT/FR2012/000282, filed on Jul. 10, 2012, designating the United States of America and claiming priority to French Patent Application No. 1102198, filed Jul. 12, 2011, and French Patent Application No. 1102199, filed Jul. 12, 2011, and this application claims priority to and the benefit of the above-identified applications, which are all incorporated by reference herein in their entireties.

This invention relates to an aluminum smelter, and more particularly the electrical conductor system for an aluminum smelter.

It is known that aluminum can be produced industrially from alumina by electrolysis using the Hall-Héroult process. An electrolytic cell comprising in particular a steel pot shell, an inner refractory lining, and a cathode of carbon material connected to conductors delivering the electrolysis current is provided for this purpose. The electrolytic cell also contains an electrolytic bath comprising mainly cryolite in which alumina is dissolved. The Hall-Héroult process consists of partly plunging a carbon block comprising the anode into this electrolytic bath, the anode being consumed as the reaction progresses. A pad of liquid aluminum forms at the bottom of the electrolytic cell.

In general plants for the production of aluminum comprise several hundred electrolytic cells. A high electrolysis current of the order of several hundred thousand amperes passes through these electrolytic cells.

There are a number of ongoing problems in aluminum smelter; these in particular comprise reducing the costs of energy consumed, the material used to manufacture the electrical conductors, and reducing dimensions to increase production from the same surface area.

Another problem arises from the existence of a strong magnetic field generated by the electrolysis current. This magnetic field disturbs the operation of the cells, reducing their efficiency. In particular the vertical component of this magnetic field causes instability in the pad of liquid aluminum.

It is known that the vertical component of the magnetic field can be reduced by compensating for the magnetic field on the scale of an electrolytic cell. This solution is implemented through a particular arrangement of the conductors delivering the electrolysis current from one cell N to a cell N+1. These conductors, generally aluminum bars, pass around the extremities of cell N. The diagram in FIG. 1 illustrates from above an electrolytic cell 100 in which the magnetic field is self-compensated through the arrangement of conductors 101 connecting this cell 100 to the next downstream cell 102. In this respect it will be noted that conductors 101 are eccentric in relation to cell 100 around which they turn. An example of a magnetically self-compensated cell is known in particular from patent document FR 2469475.

This solution imposes many design constraints because of the large space requirement due to the particular arrangement of the conductors. Furthermore the great length of the conductors for implementing this solution, generally made of aluminum, implies high material costs and large energy losses through the resistance effect of the conductors.

Another solution for reducing the vertical component of the magnetic field involves using a secondary electrical circuit formed by one or more metal electrical conductors.

This secondary electrical circuit conventionally runs along the alignment axis or axes of the electrolytic cells in the aluminum smelter. A current of a intensity which is a particular percentage of the intensity of the electrolysis current passes through this and thus produces a magnetic field that compensates for the effects of the magnetic field created by the electrolysis current.

In particular the use of a secondary circuit to reduce the effect of the magnetic field created by a line of adjacent cells through an internal and/or external loop carrying a current having a intensity of 5% to 20% of the intensity of the electrolysis current is known from patent document FR 2425482. It is also known from the article "Application of High-Tc Superconductors in Aluminum Electrolysis Plants" by Magne Runde in IEEE Transactions on applied superconductivity, vol 5, No 2, June 1995 that the use of a superconducting material to make such a secondary circuit is not economically viable.

The use of a secondary circuit to reduce the effect of the magnetic field generated by the conductors between cells by loops carrying a current having a intensity of the order of 20% to 70% of the intensity of the electrolysis current in the same direction as the electrolysis current is also known from patent document EP 0204647.

Nevertheless this solution is costly insofar as it requires a large quantity of material, conventionally aluminum, in order to produce this secondary electrical circuit or circuits. It is also costly in energy because the secondary electrical circuit(s) has (have) to be supplied with current. Finally it requires the installation of supply stations (or generators) of substantial power and size.

This invention therefore has the objective of remedying all or part of the disadvantages mentioned above and providing a solution to the problems encountered in an aluminum production plant by providing an aluminum smelter in which manufacturing and operating costs are substantially reduced and spatial requirements are smaller.

This invention therefore relates to an aluminum smelter comprising:

(i) a series of electrolytic cells designed for the production of aluminum forming one or more rows, (ii) a supply station designed to provide an electrolysis current to the series of electrolytic cells I1, the said electricity supply station having two poles, (iii) a main electrical circuit through which the electrolysis current I1 flows, having two extremities each connected to one of the poles of the supply station, (iv) at least one secondary electrical circuit comprising an electrical conductor made of superconducting material through which a current (I2, I3) flows, running along the row or rows of electrolytic cells, characterized in that the electrical conductor made of superconducting material in the secondary electrical circuit runs along the row or rows of electrolytic cells at least twice in such a way as to make several turns in series.

The use of at least one electrical conductor made of superconducting material in particular makes it possible to reduce the overall energy consumption of the aluminum smelter, and therefore the operating costs of the aluminum smelter. Furthermore, because of their smaller size, electrical conductors made of superconducting material allow for better management of the space available within the aluminum smelter. Because their mass is less than that of equivalent conductors made of aluminum, copper or steel, electrical conductors made of superconducting material require smaller and therefore less costly supporting structures.

Because of the existence of energy losses at the junctions between an electrical conductor made of superconducting material and a conventional electrical conductor, an electrical conductor made of superconducting material is particularly advantageous when it is of significant length.

The use of a secondary circuit made of superconducting material makes it possible to reduce the adverse effects of the magnetic field generated by the electrolysis current on the liquids present in the cells, achieving energy savings through the almost zero resistivity of the electrical conductors made of superconducting material which are kept below their critical temperature.

In addition, the loop formed by the secondary electrical circuit runs along the row or rows of cells several times, and comprises several turns in series. This makes it possible to divide by the number of turns the intensity of the current flowing through the electrical conductor made of superconducting material and as a consequence to reduce the cost of the electricity supply station designed to deliver this current to the secondary electrical circuit and the cost of the junctions between the poles of the supply station and the electrical conductor made of superconducting material.

Advantageously the electrical conductor made of superconducting material in the secondary electrical circuit comprises a single cryogenic casing, inside which the turns made by said electrical conductor made of superconducting material pass side by side. Such an embodiment reduces the length of the cryogenic casing and the power of the cooling system.

According to another characteristic of the aluminum smelter according to the invention the electrical conductor made of superconducting material in the secondary electrical circuit is flexible and has at least one curved part.

The secondary electrical circuit may therefore comprise one or more portions that are not straight. The flexibility of the electrical conductor made of superconducting material makes it possible to avoid obstacles (and so adjust to the spatial constraints of the aluminum smelter), but also to refine compensation of the magnetic field locally.

Advantageously, the electrical conductor made of superconducting material in the secondary electrical circuit is placed partly within an enclosure forming a magnetic shield.

This characteristic has the advantage that it prevents the electrical conductor made of superconducting material from generating a surrounding magnetic field. In particular this makes it possible to create zones for the passage of equipment or vehicles whose operation would be disturbed by the strength of the magnetic field in these passing zones, in the absence of a magnetic shield. This also makes it possible to avoid the use of costly equipment having screening to protect it from strong magnetic fields.

Preferably the enclosure forming the magnetic shield is located at at least one of the extremities of the row or rows of electrolytic cells.

According to another characteristic of the aluminum smelter according to the invention the secondary electrical circuit comprises two extremities, each extremity of said secondary electrical circuit being connected to an electrical pole of a supply station which is not the same as the supply station for the main electrical circuit.

Advantageously the electrical conductor made of superconducting material in the secondary electrical circuit runs along the row or rows of electrolytic cells a predetermined number of times so that a secondary electrical circuit supply station delivering a current of intensity between 5 kA and 40 kA can be used.

The electrical conductor made of superconducting material therefore makes as many turns in series as are required for it to be possible to use a supply station which can be easily obtained commercially and which is economically beneficial.

According to another characteristic of the aluminum smelter according to the invention, at least part of the electrical conductor made of superconducting material in the secondary electrical circuit is located beneath at least one electrolytic cell in the row or rows.

According to yet another characteristic of the aluminum smelter according to the invention, part at least of the electrical conductor made of superconducting material in the secondary electrical circuit runs along the right-hand side and/or left-hand side of the electrolytic cells in the row or rows.

According to another characteristic of the aluminum smelter according to the invention, each electrical conductor made of superconducting material is formed of a cable comprising a central core of copper or aluminum, at least one fiber of superconducting material and a cryogenic casing.

According to another characteristic of the aluminum smelter according to the invention, a cooling fluid flows through the cryogenic casing.

Advantageously the cooling fluid is liquid nitrogen and/or helium.

Figure 2:
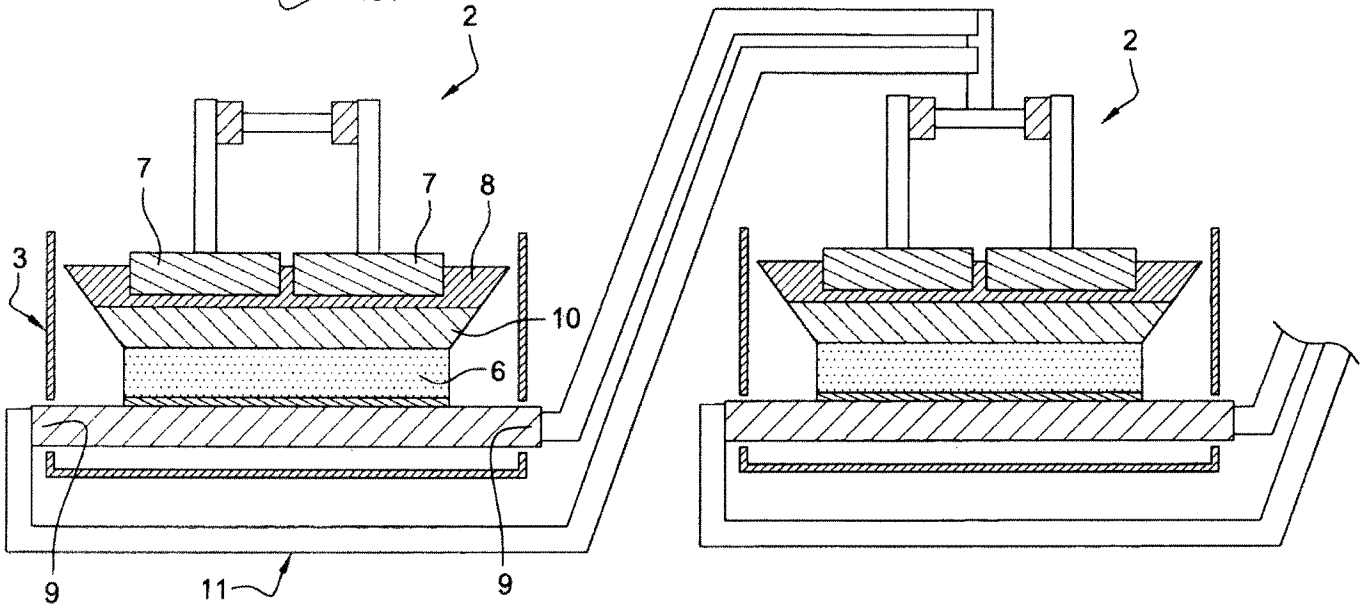
Figure 6:
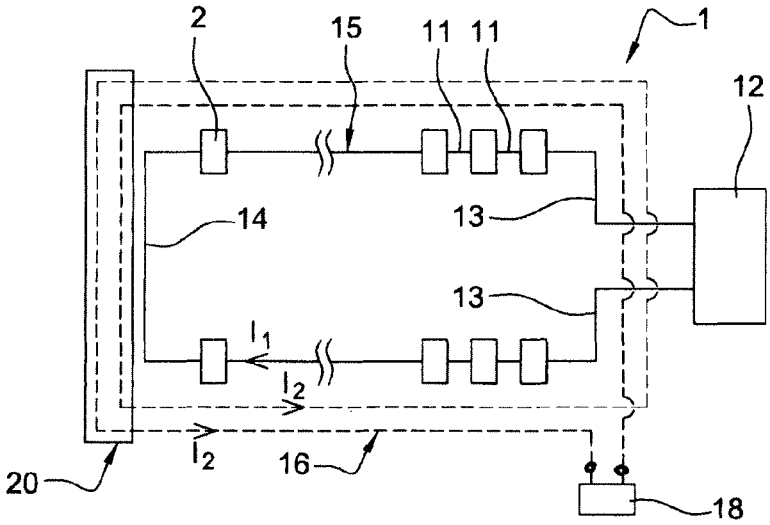
Figure 7:
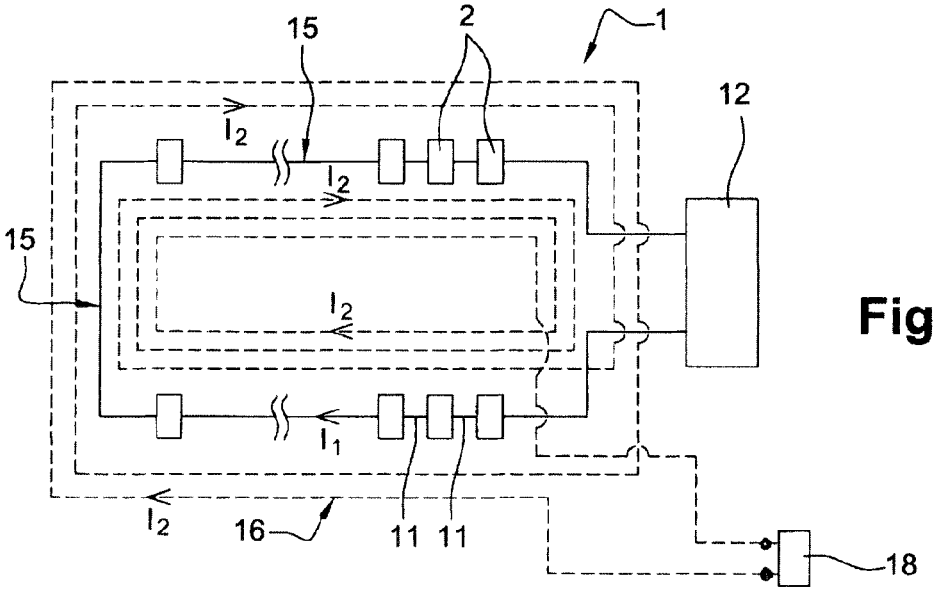
Figure 8:
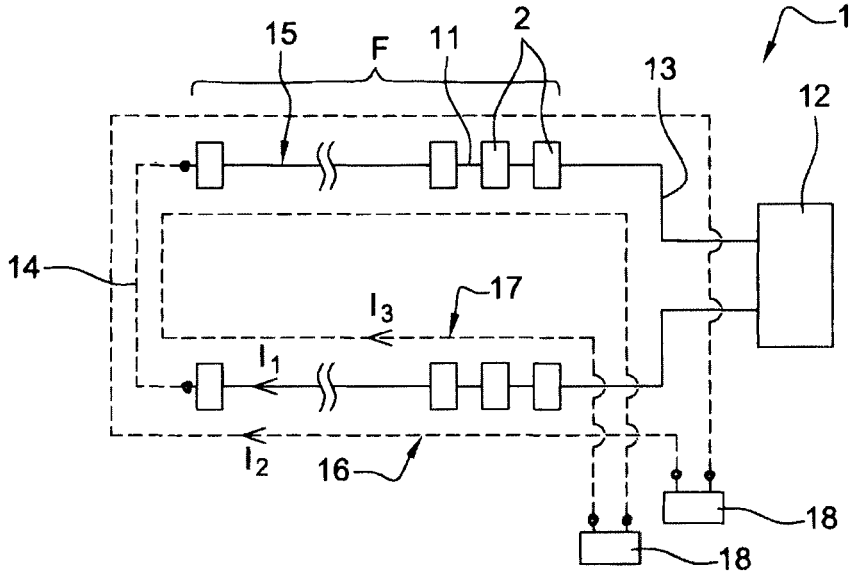
Figure 9:
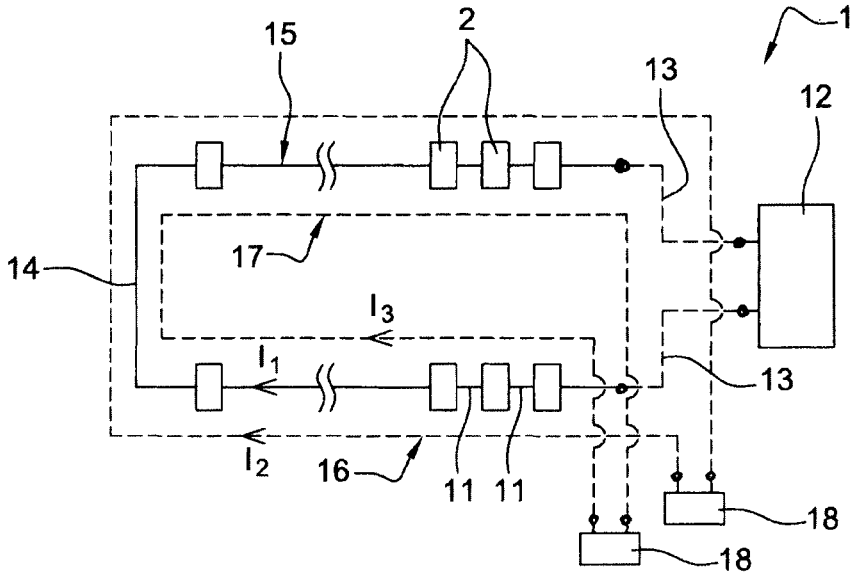
Figure 10:
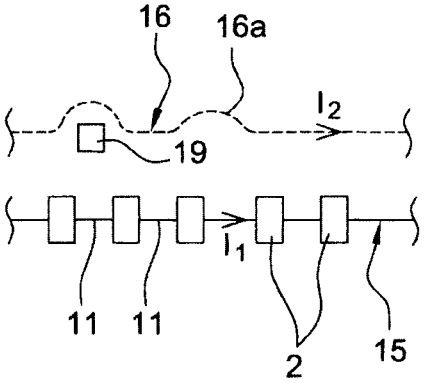
Figure 11:
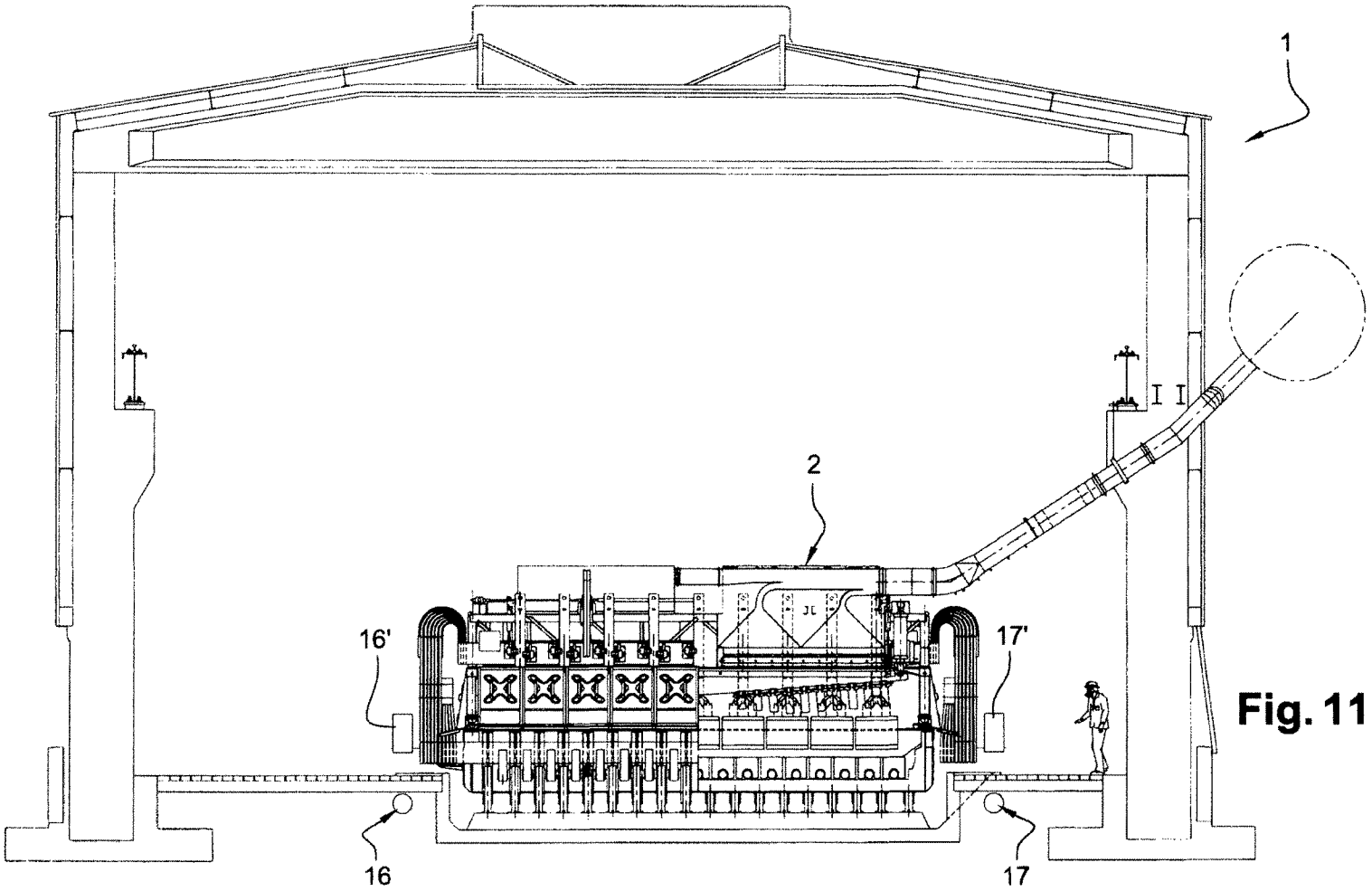

The invention will be better understood from the detailed description provided below in relation to the appended figures in which:

FIG. 1 is a diagrammatical view from above of a state-of-the-art electrolytic cell, FIG. 2 is a side view of a state-of-the-art electrolytic cell, FIGS. 3, 4, 5, 6 and 7 are diagrammatical views from above of an aluminum smelter in which at least one electrical conductor made of superconducting material is used in a secondary electrical circuit, FIGS. 8 and 9 are diagrammatical views from above of an aluminum smelter in which an electrical conductor made of superconducting material is used in a secondary electrical circuit, FIG. 10 is a partial diagrammatic view from above of an aluminum smelter comprising a secondary electrical circuit equipped with a curved portion, FIG. 11 is a cross-sectional view of an electrolytic cell in an aluminum smelter showing one particular positioning of the electrical conductors made of superconducting material in the two secondary electrical circuits and also showing the positioning which would have had to be used for conventional electrical conductors made of aluminum or copper, FIG. 2 shows a conventional example of an electrolytic cell 2. Electrolytic cell 2 in particular comprises a metal pot shell 3, made, for example, of steel. Metal pot shell 3 is lined internally with refractory and/or insulating materials, for example bricks. Electrolytic cell 2 also has a cathode 6 made of carbon material and a plurality of anodes 7 which are designed to be consumed as the electrolysis reaction in an electrolytic bath 8 comprising in particular cryolite and alumina progresses. A covering of alumina and crushed bath generally covers the electrolyte bath 8 and at least partially the anodes 7. During the electrolysis reaction, a pad of liquid aluminum 10 is formed. Cathode 6 is electrically connected to cathode outputs 9 in the form of metal bars passing through pot shell 3, cathode outlets 9 being themselves connected to electrical conductors 11 from cell to cell. Electrical conductors 11 from cell to cell deliver electrolysis current I1 from one electrolytic cell 2 to another. Electrolysis current I1 passes through the conducting members of each electrolytic cell 2: first an anode 7, then electrolytic bath 8, liquid aluminum pad 10, cathode 6 and finally electrical conductors 11 from cell to cell connected to cathode outputs 9, so that electrolysis current I1 is then delivered to anode 7 in next electrolytic cell 2.

The electrolytic cells 2 of an aluminum smelter 1 are conventionally arranged and electrically connected in series. A series may include one or more rows of electrolytic cells 2. When the series comprises several rows F, they are generally straight and parallel to each other, and are advantageously even in number.

Figure 3:
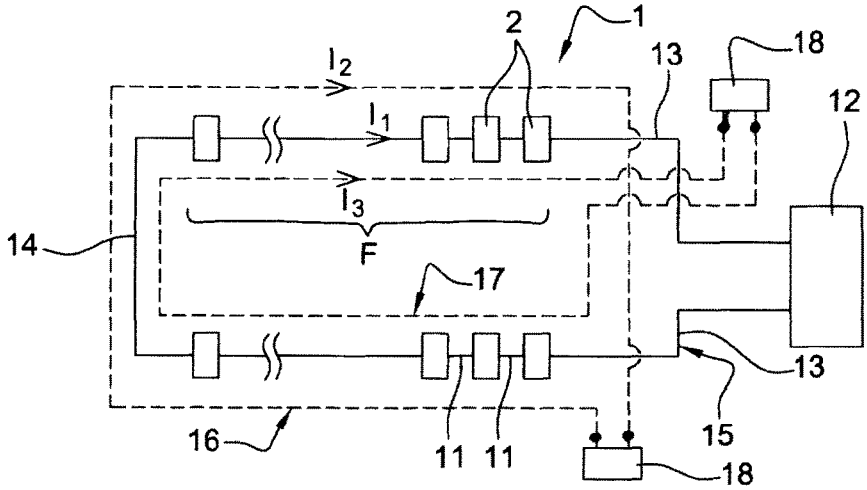

Aluminum smelter 1, an example of which may be seen in FIG. 3, comprises a main electrical circuit 15 through which an electrolysis current I1 flows. The intensity of electrolysis current I1 may reach values of the order of several hundred thousand amperes, for example of the order of from 300 kA to 600 kA.

A supply station 12 supplies the series of electrolytic cells 2 with electrolysis current I1. The extremities of the series of electrolytic cells 2 are each connected to one electric pole of supply station 12. Linking electrical conductors 13 connect the electrical poles of supply station 12 to the extremities of the series.

The rows F in one series are electrically connected in series. One or more linking electrical conductors 14 delivers electrolysis current I1 from the last electrolytic cell 2 in a row F to the first electrolytic cell 2 in the next row F.

Main electrical circuit 15 comprises linking electrical conductors 13 connecting the extremities of the series of electrolytic cells 2 to supply station 12, linking electrical conductors 14 connecting rows F of electrolytic cells 2 to each other, electrical conductors 11 between cells connecting two electrolytic cells 2 in the same row F, and conducting elements of each electrolytic cell 2.

Conventionally 50 to 500 electrolytic cells 2 are connected in series and extend along two rows F, each more than 1 km long.

The aluminum smelter 1, according to one embodiment of the present invention also includes one or more secondary electrical circuits 16, 17, visible for example in FIG. 3. These secondary electrical circuits 16, 17 conventionally run along the lines F of electrolytic cells 2. They are able to compensate for the magnetic field generated by the high intensity of electrolysis current I1, which causes instability in electrolysis bath 8 and thus affects the efficiency of electrolytic cells 2.

A current I2, I3, delivered by a supply station 18, flows through each secondary electrical circuit 16, 17 respectively. Supply station 18 for each secondary circuit 16, 17 is separate from supply station 12 for main circuit 15.

The aluminum smelter 1 comprises at least one secondary electrical circuit 16, 17 provided with an electrical conductor made of superconducting material.

These superconducting materials may for example comprise BiSrCaCuO, YaBaCuO, MgB2, materials known from patent applications WO 2008011184, US 20090247412 or yet other materials known for their superconducting properties.

Superconducting materials are used to carry current with little or no loss due to generation of heat by the Joule effect, because their resistivity is zero when they are kept below their critical temperature. Because there is no energy loss a maximum amount of the energy received by the aluminum smelter (for example 600 kA and 2 kV) can be delivered to main electrical circuit 15 which produces aluminum, and in particular the number of cells 2 can be increased.

By way of example, a superconducting cable used to implement this invention comprises a central core of copper or aluminum, tapes or fibers of superconducting material, and a cryogenic casing. The cryogenic casing may be formed of a sheath containing cooling fluid, for example liquid nitrogen. The cooling fluid makes it possible to keep the temperature of the superconducting materials at a temperature below their critical temperature, for example below 100 K (Kelvin), or between 4 K and 80 K.

Because energy losses are located at the junctions between the electrical conductor made of superconducting material and the other electrical conductors, electrical conductors of superconducting material are particularly advantageous when they are of some length, and more particularly of a length of 10 m or more.

Figure 4:
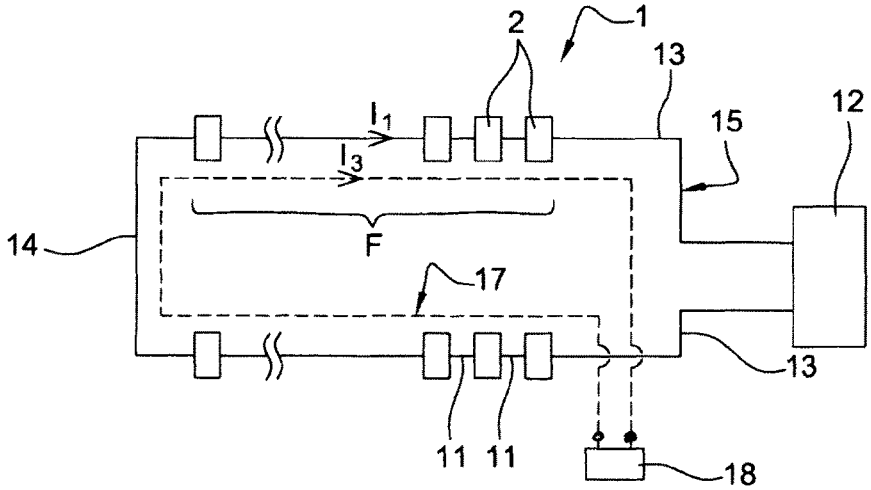
Figure 5:
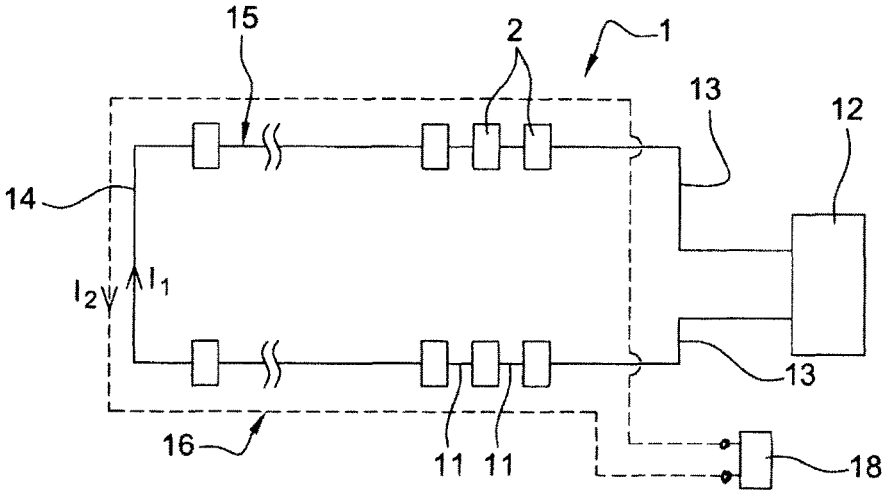

FIGS. 3, 4 and 5 illustrate different possible embodiments of an aluminum smelter 1 according to the invention by way of non-exhaustive examples. In the different figures the electrical conductors made of superconducting material are illustrated by dotted lines.

The embodiment in FIG. 3 illustrates an aluminum smelter 1 comprising two secondary electrical circuits 16 and 17, through which currents of intensity I2 and I3 each provided by a supply station 18. Currents I2 and I3 flow through secondary electrical circuits 16 and 17 respectively in the same direction as electrolysis current I1. In this case secondary electrical circuits 16 and 17 provide compensation for the magnetic field generated by electrical conductors 11 connecting cells. The intensity of each of electrical currents I2, I3 is great, for example between 20% and 100% of the intensity of electrolysis current I1 and preferably 40% to 70%.

Compensation for the magnetic field in adjacent row F may also be obtained through the embodiment in FIG. 4. Aluminum smelter 1 illustrated in FIG. 4 comprises a secondary electrical circuit 17 forming an internal loop through which an electrical current I3 flows.

It is also possible to compensate for the magnetic field in adjacent row F by providing a single secondary circuit 16 forming an external loop through which a current I2 in the direction contrary to electrolysis current I1 flows, as illustrated in FIG. 5.

It is useful to use of electrical conductors made of superconducting material to form secondary circuit or circuits 16, 17 because of the length of secondary electrical circuits 16, 17, of the order of two kilometers. The use of electrical conductors made of superconducting material requires a lesser voltage in comparison with that required by electrical conductors made of aluminum or copper. It is therefore possible to reduce the voltage from 30 V to 1 V where secondary electrical circuit or circuits 16, 17 comprise electrical conductors made of superconducting material. This represents a reduction in energy consumption of the order of 75% to 99% in comparison with aluminum electrical conductors of the conventional type. Furthermore the cost of supply station 18 for the secondary electrical circuit or circuits is as a consequence reduced.

Aluminum smelter 1 comprises a secondary electrical circuit 16, 17 having an electrical conductor made of superconducting material and advantageously running along the same row F of electrolytic cells 2 at least twice, as may in particular be seen in FIGS. 6 and 7.

Because the loop formed by a secondary electrical circuit 16, 17 comprises several turns in series, the intensity of current I2, I3 passing through secondary electrical circuit 16, 17 can, for the same magnetic effect, be divided by as many times as the number of turns provided. The reduction in this current intensity also makes it possible to reduce energy losses due to the Joule effect at junctions and the cost of junctions between electrical conductors made of superconducting material and the inputs or outputs of electrical conductors for the secondary electrical circuit 16, 17. The decrease in the overall intensity of the current flowing through each secondary electrical circuit 16, 17 with electrical conductors made of superconducting material makes it possible to reduce the size of supply station 18 associated with them. For example, for a loop which has to deliver a current of 200 kA, twenty turns of electrical conductor made of superconducting material make it possible to use a supply station 18 delivering 10 kA. Likewise 40 turns of electrical conductor made of superconducting material would make it possible use a supply station delivering a current having a intensity of 5 kA. This would therefore make it possible to use equipment which is currently sold commercially, and is therefore less costly.

Furthermore, the use of one or more turns in series to form secondary electrical circuits 16, 17 made of superconducting material has the advantage of reducing the magnetic fields on the route between supply station 18 and the first and last electrolytic cell 2, because the current intensity along this route is low (a single pass of the electrical conductor).

The small size of electrical conductors made of superconducting material in comparison with electrical conductors made of aluminum or copper (cross-section up to 150 times smaller than the cross-section of a copper conductor for the same intensity, and even more in relation to an aluminum conductor) makes it easy to produce several turns in series in the loops formed by secondary electrical circuits 16, 17.

Aluminum smelter 1 according to the embodiment illustrated in FIG. 6 comprises a secondary electrical circuit 16 whose electrical conductors twice run in series the length of rows F of the series. In the embodiment in FIG. 7, aluminum smelter 1 comprises a secondary electrical circuit 16 which runs down both the left and right-hand sides of electrolytic cells 2 in the series (the left and right-hand sides being defined in relation to an observer located on main electrical circuit 15 and looking in the direction of the overall flow of electrolysis current I1). Furthermore the electrical conductors (made of superconducting material) of secondary electrical circuit 16 in aluminum smelter 1 illustrated in FIG. 7 make several turns in series, including two turns running along the left-hand sides of cells 2 in the series and three turns running along the right-hand sides. The number of turns may be twenty and thirty respectively. The difference between the number of turns to be made on each side is determined as a function of the distance between the rows in order to obtain optimum magnetic balance.

Because of the small potential difference between two turns of the electrical conductor made of superconducting material it is easy to insulate the various turns of the electrical conductor. A thin electrical insulator located between each turn of the electrical conductor made of superconducting material is sufficient.

For this reason, and because of the small size of the electrical conductor made of superconducting material, it is possible to contain the electrical conductor made of superconducting material of a circuit within a single cryogenic casing, regardless of the number of turns made by this conductor. This cryogenic casing may comprise a thermally-insulated sheath through which a cooling fluid circulates. In a given location, the cryogenic casing may contain several passages of the same electrical conductor made of superconducting material side by side.

This would give rise to more constraints in the case of electrical conductors of aluminum or copper making several turns around the series of electrolytic cells. Electrical conductors made of aluminum or copper are in fact more bulky than electrical conductors made of superconducting material. Furthermore, because of the large drop in potential which would be present between each turn it would be necessary to add costly insulators which would have to be fitted and maintained. Because conventional electrical conductors made of aluminum or copper heat up when in operation, fitting an insulator between the various turns of the conductor would give rise to heat-removal problems.

Electrical conductors made of superconducting material also have the advantage over electrical conductors made of aluminum or copper in that they can be flexible. Aluminum smelter 1 may therefore comprise one or more secondary electrical circuits 16, 17 incorporating an electrical conductor made of superconducting material having at least one curved part. This makes it possible to pass around obstacles 19 present within aluminum smelter 1, for example pillars, as may be seen in FIG. 10.

This also makes it possible to make local adjustments to compensation of the magnetic field in aluminum smelter 1 by locally adjusting the position of the electrical conductor made of superconducting material in secondary electrical circuit or circuits 16, 17, as is permitted by the curved part 16*a* of secondary electrical circuit 16 in aluminum smelter 1 which may be seen in FIG. 10. This flexibility makes it possible to move the electrical conductor made of superconducting material from its initial position to correct the magnetic field by adjusting to change in aluminum smelter 1 (for example an increase in the intensity of the electrolysis current I1, or to use the results of the most recent magnetic correction calculations made available through the new power of computers and general knowledge of the subject).

It should be noted that the electrical conductors made of superconducting material in secondary electrical circuit or circuits 16, 17 may be located beneath electrolytic cells 2. I In particular, they may be buried. This arrangement is made possible by the small size of electrical conductors made of superconducting material and by the fact that they do not heat up. This arrangement would be difficult to achieve with electrical conductors made of aluminum or copper because they are of larger size for the same current intensity, and because they heat up and therefore need to be cooled (currently in contact with air and/or using specific cooling means). For a given layout of aluminum smelter 1 FIG. 11 shows possible locations for secondary electrical circuits 16, 17 with electrical conductors made of superconducting material and secondary electrical circuits 16', 17' using aluminum electrical conductors. Secondary electrical circuits 16', 17' are located on either side of an electrolytic cell 2. As illustrated in FIG. 11, secondary electrical circuits 16', 17' impede access to electrolytic cells 2, for example for maintenance work. They cannot however be located beneath electrolytic cells 2, like secondary electrical circuits 16, 17 with electrical conductors made of superconducting material because they have larger dimensions and need to be cooled. Secondary electrical circuits 16, 17 using electrical conductors made of superconducting material may conversely be located beneath electrolytic cells 2. Access to electrolytic cells 2 is therefore not restricted.

According to a particular embodiment of the invention, an example of which is illustrated in FIG. 6, the electrical conductors made of superconducting material may be partly contained within an enclosure 20 forming a magnetic shield. This enclosure 20 may be a metal tube, for example made of steel. This brings about a substantial reduction in the magnetic field outside this magnetic shield. This therefore makes it possible to create passage zones in locations where this enclosure 20 has been placed, in particular for vehicles whose operation would have been disturbed by the magnetic field emanating from the electrical conductors made of superconducting material. This therefore makes it possible to reduce the cost of these vehicles (which would otherwise have to be provided with protection). This enclosure 20 may advantageously be placed around electrical conductors made of superconducting material located at the end of a row F, as illustrated in FIG. 6.

Enclosure 20 forming a magnetic shield can also be formed of superconducting material kept below its critical temperature. Advantageously, this enclosure made of superconducting material forming a magnetic shield may be placed closer to the electrical conductors made of superconducting material, within the cryogenic casing. The mass of superconductive material of the enclosure is minimized and the superconducting material of the enclosure is kept below its critical temperature without the need to have another special cooling system.

It is not possible to use a protective enclosure 20 with conventional electrical conductors according to prior art made of aluminum or even of copper. These aluminum electrical conductors effectively have a large dimensional cross-section, of the order of 1 m by 1 m, against a diameter of 25 cm for an electrical conductor made of superconducting material. Above all, electrical conductors made of aluminum heat up when in operation. The use of such an enclosure 20 forming a magnetic field would not make it possible to properly evacuate the heat generated.

It should also be noted that electrical conductors made of superconducting material have a mass per meter which may be twenty times less that of an aluminum electrical conductor for an equivalent current intensity. The cost of supports for electrical conductors made of superconducting material is therefore less and they are easier to install.

Main electrical circuit 15 in aluminum smelter 1 may also comprise one or more electrical conductors made of superconducting material. So linking electrical conductors 14 electrically linking rows F together in the series may be made of superconducting material, as illustrated in FIG. 8. Linking electrical conductors 13 linking the extremities of the series of electrolytic cells 2 to the poles of supply station 12 for main circuit 15 may also be made of superconducting material, as illustrated in FIG. 9.

In a conventional aluminum smelter linking electrical conductors 14 joining two rows F measure 30 m to 150 m depending on whether the two rows F which they connect are located in the same building or in two separate buildings for reasons of magnetic interaction between these two rows F. Linking electrical conductors 13 connecting the extremities of the series to the pole of supply station 12 generally measure between 20 m and 1 km depending upon the positioning of this supply station 12. Because of these lengths it will be easily understood that the use of electrical conductors made of superconducting materials in these locations will make it possible to achieve energy savings. The other advantages brought about through the use of conductors made of superconducting materials described previously, such as their small size or flexibility, or their ability to be placed in an enclosure forming a magnetic shield also justify the potential use of electrical conductors made of superconducting material in main circuit 15 of aluminum smelter 1.

Conversely, because electrical conductors 11 joining cells are shorter, and because of the energy losses at junctions, use of an electrical conductor made of superconducting material to deliver the electrolysis current from one cell 2 to another is not economically advantageous.

So use of electrical conductors made of superconducting material in an aluminum smelter 1 may prove advantageous where the conductors are sufficiently long. The use of electrical conductors made of conducting material is particularly advantageous in the case of secondary electrical circuits 16, 17 designed to reduce the cell-to-cell magnetic field effect through loops of the type described in patent document EP 0204647—when the intensity of the current flowing in main electrical circuit 15 is particularly high, over 350 kA., and when the sum of the current intensities flowing in the secondary electrical circuit in the same direction as the current flowing in the main circuit lies between 20% and 100% of the current in the main circuit, and preferably from 40% to 70%.

The embodiments described are of course not exclusive of each other and may be combined to reinforce the technical effect obtained through synergy. So a main electrical circuit 15 comprising both linking electrical conductors 14 made of superconducting material linking the rows and linking electrical conductors 13 connecting the extremities of one series to the poles of supply station 12 also made of superconducting material, and one or more secondary electrical circuits 16, 17 also comprising electrical conductors made of superconducting material making several turns in series, may be envisaged. A single secondary electrical circuit 16 comprising electrical conductors made of superconducting material may also be provided between the rows F of cells 2 or outside the latter, with the conductors making several turns in series.

Finally, the invention is not in any way restricted to the embodiments described above, these embodiments being provided only by way of example. Changes remain possible, particularly from the point of view of the constitution of the various components or substitution by technical equivalents without thereby going beyond the scope of protection of the invention.

In particular the invention may extend to aluminum smelter using electrolysis with inert anodes.

It may also be applied generally to loops of all other kinds, for example to the type of loops described in the patent documents CA 2585218, FR 2868436, and EP 1812626.

The invention claimed is:

1. An aluminum smelter comprising:

(i) a series of electrolytic cells, designed for production of aluminum, forming one or more rows, (ii) a supply station designed to supply the series of electrolytic cells with an electrolysis current, the supply station comprising two poles, (iii) a main electrical circuit through which the electrolysis current flows, having two extremities each connected to one of the poles of the supply station, and (iv) at least one secondary electrical circuit comprising an electrical conductor made of superconducting material through which a current flows, running along the one or more rows of electrolytic cells, characterized in that the electrical conductor made of superconducting material in the secondary electrical circuit runs along the row or rows of electrolytic cells at least twice in such a way as to make several complete turns in series.

2. An aluminum smelter according to claim 1, characterized in that the electrical conductor made of superconducting material in the secondary electrical circuit comprises a single cryogenic casing within which run side by side the turns made by said electrical conductor made of superconducting material.

3. An aluminum smelter according to claim 1, characterized in that the electrical conductor made of superconducting material in the secondary electrical circuit is flexible and has at least one curved part.

4. An aluminum smelter according to claim 1, characterized in that the secondary electrical circuit comprises two extremities, each extremity of said secondary electrical circuit being connected to one electrical pole of a supply station which is separate from the supply station for the main electrical circuit.

5. A method comprising:

providing an aluminum smelter, comprising:

(i) a series of electrolytic cells, designed for the production of aluminum, forming one or more rows, (ii) a supply station designed to supply the series of electrolytic cells with an electrolysis current, the supply station comprising two poles, (iii) a main electrical circuit through which the electrolysis current flows, having two extremities each connected to one of the poles of the supply station, and (iv) at least one secondary electrical circuit comprising an electrical conductor made of superconducting material through which a current flows, running along the one or more rows of electrolytic cells, characterized in that the electrical conductor made of superconducting material in the secondary electrical circuit runs along the row or rows of electrolytic cells at least twice in such a way as to make several complete turns in series, and characterized in that the secondary electrical circuit comprises two extremities, each extremity of said secondary electrical circuit being connected to one electrical pole of a supply station which is separate from the supply station for the main electrical circuit; and delivering the current of intensity between 5 kA and 40 kA from the supply station through the secondary electrical circuit, characterized in that the electrical conductor made of superconducting material in the secondary electrical circuit runs along the one or more rows of electrolytic cells a predetermined number of times so as to allow use of the supply station for the secondary electrical circuit delivering the current of intensity between 5 kA and 40 kA.

6. An aluminum smelter according to claim 1, characterized in that at least one part of the electrical conductor made of superconducting material in the secondary electrical circuit is located beneath at least one electrolytic cell in the one or more rows.

7. An aluminum smelter according to claim 1, characterized in that at least part of the electrical conductor made of superconducting material in the secondary electrical circuit runs along a right-hand side and/or a left-hand side of the electrolytic cells in the one or more rows.

8. An aluminum smelter according to claim 1, characterized in that the electrical conductor made of superconducting material is formed of a cable comprising a central core of copper or aluminum, at least one fiber of superconducting material and a cryogenic casing.

9. An aluminum smelter according to claim 8, characterized in that a cooling fluid flows through the cryogenic casing.

10. An aluminum smelter according to claim 9, characterized in that the cooling fluid is liquid nitrogen and/or helium.

11. An aluminum smelter according to claim 1, characterized in that the electrical conductor made of superconducting material is placed partly within an enclosure forming a magnetic shield.

12. An aluminum smelter according to claim 11, characterized in that the enclosure forming the magnetic shield is located at least one of the extremities of the one or more rows of electrolytic cells.

13. An aluminum smelter according to claim 1, characterized in that the secondary electrical circuit runs along the row or rows of electrolytic cells at least twice in such a way that the current flowing through the secondary electrical circuit runs along the row or rows of electrolytic cells at least twice in a same direction.

14. A method according to claim 5, characterized in that the secondary electrical circuit runs along the row or rows of electrolytic cells at least twice in such a way that the current flowing through the secondary electrical circuit runs along the row or rows of electrolytic cells at least twice in a same direction.

* * * * *